US008487733B2

(12) United States Patent
Chu et al.

(10) Patent No.: US 8,487,733 B2
(45) Date of Patent: Jul. 16, 2013

(54) COMPOSITE MAGNETIC CORE ASSEMBLY, MAGNETIC ELEMENT AND FABRICATING METHOD THEREOF

(75) Inventors: Jiang Chu, Shanghai (CN); Wei Chen, Shanghai (CN); I-Chi Cheng, Taoyuan Hsien (TW); Yi-Fan Wu, Taoyuan Hsien (TW); Zhi Huang, Shanghai (CN)

(73) Assignee: Delta Electronics, Inc., Taoyuan Hsien (TW)

( * ) Notice: Subject to any disclaimer, the term of this patent is extended or adjusted under 35 U.S.C. 154(b) by 82 days.

(21) Appl. No.: 12/951,315

(22) Filed: Nov. 22, 2010

(65) Prior Publication Data

US 2011/0121935 A1 May 26, 2011

(30) Foreign Application Priority Data

Nov. 24, 2009 (CN) ..... 2009 1 0225024

(51) Int. Cl.
*H01F 27/24* (2006.01)
*H01F 17/04* (2006.01)

(52) U.S. Cl.
USPC ..... 336/212; 336/221; 336/233

(58) Field of Classification Search
USPC ..... 336/212, 219, 221, 233
See application file for complete search history.

(56) References Cited

U.S. PATENT DOCUMENTS

| | | | | | |
|---|---|---|---|---|---|
| 4,013,911 | A * | 3/1977 | Fujiwara et al. | ..... | 340/870.35 |
| 4,047,138 | A * | 9/1977 | Steigerwald | ..... | 336/100 |
| 4,117,436 | A * | 9/1978 | MacLennan | ..... | 336/65 |
| 4,149,135 | A * | 4/1979 | Roespel et al. | ..... | 336/65 |
| 4,240,057 | A * | 12/1980 | Decher et al. | ..... | 336/165 |
| 4,419,705 | A * | 12/1983 | Brower et al. | ..... | 360/235.3 |
| 4,498,067 | A * | 2/1985 | Kumokawa et al. | ..... | 336/65 |
| 4,613,841 | A * | 9/1986 | Roberts | ..... | 336/83 |
| 4,713,589 | A * | 12/1987 | Kashiwagi | ..... | 315/400 |
| 4,943,793 | A * | 7/1990 | Ngo et al. | ..... | 336/83 |
| 5,062,197 | A * | 11/1991 | Ngo et al. | ..... | 29/606 |
| 5,506,560 | A * | 4/1996 | Takeuchi et al. | ..... | 336/83 |
| 5,689,478 | A * | 11/1997 | Ishii et al. | ..... | 369/13.17 |
| 5,726,615 | A * | 3/1998 | Bloom | ..... | 336/83 |
| 6,323,634 | B1 * | 11/2001 | Nakagawa et al. | ..... | 324/117 R |
| 6,753,751 | B2 * | 6/2004 | Fujiwara et al. | ..... | 336/110 |
| 7,427,909 | B2 * | 9/2008 | Ono et al. | ..... | 336/90 |
| 7,449,984 | B2 * | 11/2008 | Kawarai | ..... | 336/83 |
| 7,652,406 | B2 * | 1/2010 | Kim et al. | ..... | 310/266 |

* cited by examiner

*Primary Examiner* — Mohamad Musleh
*Assistant Examiner* — Joselito Baisa
(74) *Attorney, Agent, or Firm* — Kirton McConkie; Evan R. Witt

(57) ABSTRACT

A composite magnetic core assembly includes an inner magnetic core and an outer magnetic core. The inner magnetic core is made of a high saturation flux density and low permeability material. The outer magnetic core is made of a low saturation flux density and high permeability material. The outer magnetic core includes a ring-shaped wall and a receptacle. The inner magnetic core is accommodated within the receptacle.

20 Claims, 6 Drawing Sheets

COMPOSITE MAGNETIC CORE ASSEMBLY, MAGNETIC ELEMENT AND FABRICATING METHOD THEREOF

FIELD OF THE INVENTION

The present invention relates to a magnetic core assembly, and more particularly to a composite magnetic core assembly. The present invention also relates to a magnetic element including the composite magnetic core assembly and a fabricating method thereof.

BACKGROUND OF THE INVENTION

Magnetic elements such as inductors or transformers are widely used in switch-mode power converters. The magnetic element is a key component influencing power density, efficiency and reliability of the power converter. Conventionally, the magnetic element (e.g. an inductor) used in the switch-mode power converter is made of ferrite, ring-shaped powder core, or the like. Since different magnetic core materials have different hysteresis properties, the losses of different magnetic cores are distinguished. Generally, the magnetic core loss is resulted from alternate magnetic fields within the magnetic core. The magnetic core loss is a function of the operating frequency and the total magnetic flux swing ($\Delta B$). The magnetic core loss usually includes hysteresis loss, eddy-current loss and residual loss. As the permeability is increased, the hysteresis curve becomes narrower and the power consumption of the magnetic core is reduced. The magnetic core made of ferrite is cost-effective and has low power consumption of the magnetic core. Since the saturation flux density of ferrite is low, an air gap and a Litz wire are necessary. In such situation, the overall volume is relatively huge. On the other hand, the magnetic core made of ring-shaped powder core has higher saturation flux density and may store larger amount of energy. The process of fabricating an inductor by using the ring-shaped powder core needs a manual winding step, and thus the fabricating process is time-consuming. For simplifying the winding step of the fabricating process, the advantages of the ferrite and ring-shaped powder core combined together in the practical applications.

According to the magnetic path designs, the above two materials are combined together by either connected in parallel or in series. In a case that the two materials are combined together in parallel, the functions of these two materials are added but the overall volume is increased. In a case that the two materials are combined together in series, the functions of these two materials are moderate but the overall volume is reduced.

For preventing core saturation and minimizing eddy-current loss, U.S. Pat. No. 6,980,077 disclosed a method of filling the air gap of the magnetic path by using a magnetic powder core. This method is applied to ferrite EI or EE magnetic core assembly. The magnetic path is increased by filling the air gap with the magnetic powder core. In practice, for maintaining the original anti-saturation property, the length of the magnetic powder core should be extended. By the calculating method disclosed in this patent, the magnetic powder core (having the same permeability as the current standard magnetic powder core) is usually longer than the center legs of the EI and EE magnetic core assemblies. In other words, the application thereof is largely restricted. In a case that the permeability of the magnetic powder core is further reduced, the fringing flux is increased and a near-field radiation problem occurs.

U.S. Pat. No. 7,265,648 disclosed a method for achieving nonlinear inductance by using a high permeability material. In this method, two magnetic core members (one of them has an air gap) are connected in parallel. In practice, the magnetic core member with the air gap may incur near-field radiation, electromagnetic interference and high eddy-current loss. In a case that a ferrite magnetic core and an alloy magnetic powder core are parallel, better performance is achieved. This patent, however, fails to obviate the above drawbacks encountered from the prior art.

U.S. Pat. No. 5,062,197 disclosed a method of providing a high-frequency inductor or transformer by using two magnetic materials. This method uses too many components and is very complicated. Since the center leg is made of a high saturation flux density and low permeability material (e.g. ferrite), the cross-section area and the mean turn length are increased. In this situation, the resistance is increased. In addition, the two low-permeability layers within the magnetic core incur a large magnetic pressure distribution. As such, the near-field radiation and electromagnetic interference problems are incurred.

From the above discussions, it is found that the conventional magnetic elements fail to effectively increase the operating efficiency, shortening the fabricating time or reducing the cost and overall volume of the magnetic core assembly. For obviating the drawbacks encountered from the prior art, there is a need of combining two magnetic core materials and quickly assembling a magnetic element in a simplified manner.

SUMMARY OF THE INVENTION

It is an object of the present invention to provide a composite magnetic core assembly, a magnetic element and a fabricating method for increasing operating efficiency, shortening fabricating time and reducing cost and overall volume by connecting alloy powder core and ferrite in series.

Another object of the present invention provides a composite magnetic core assembly, a magnetic element and a fabricating method for reducing DC resistance, copper loss and near-field radiation.

In accordance with an aspect of the present invention, there is provided a composite magnetic core assembly. The composite magnetic core assembly includes an inner magnetic core and an outer magnetic core. The inner magnetic core is made of a high saturation flux density and low permeability material. The outer magnetic core is made of a low saturation flux density and high permeability material. The outer magnetic core includes a ring-shaped wall and a receptacle. The inner magnetic core is accommodated within the receptacle.

In accordance with another aspect of the present invention, there is provided a magnetic element. The magnetic element includes a composite magnetic core assembly and a winding coil. The composite magnetic core assembly includes an inner magnetic core and an outer magnetic core. The inner magnetic core is made of a high saturation flux density and low permeability material. The outer magnetic core is made of a low saturation flux density and high permeability material. The outer magnetic core comprises a ring-shaped wall and a receptacle. The inner magnetic core is accommodated within the receptacle. The winding coil is wound around the inner magnetic core, and accommodated within the receptacle of the outer magnetic core.

In accordance with a further aspect of the present invention, there is provided a fabricating method of a magnetic element. Firstly, an inner magnetic core made of a high saturation flux density and low permeability material, an outer magnetic core made of a low saturation flux density and high permeability material and a winding coil are provided. The outer magnetic core has a ring-shaped outer wall and a receptacle. Then, the winding coil is wound around the inner magnetic core, and the inner magnetic core and the winding coil is accommodated within the receptacle of the outer magnetic core.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
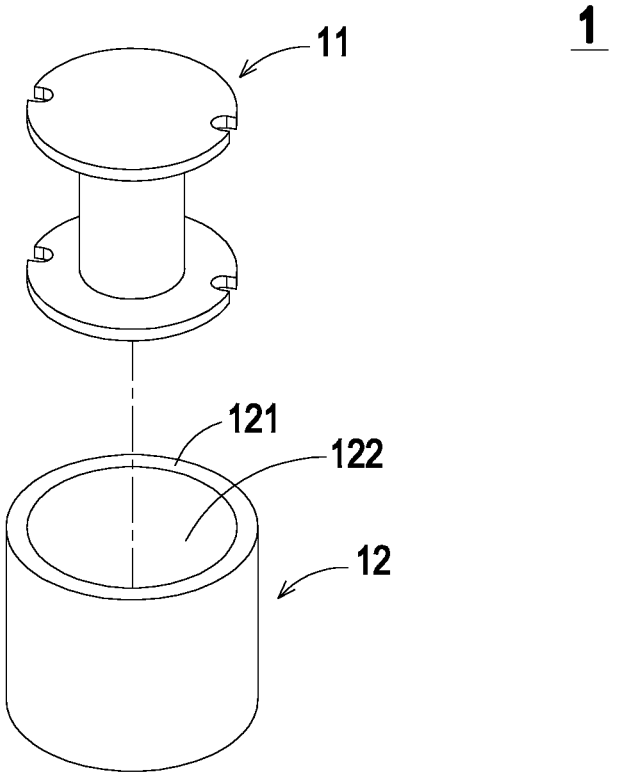
FIG. 1 is a schematic exploded view illustrating a magnetic core assembly according to an embodiment of the present invention.

FIG. 1 is a schematic exploded view illustrating a composite magnetic core assembly according to an embodiment of the present invention. As shown in FIG. 1, the composite magnetic core assembly 1 comprises an inner magnetic core 11 and an outer magnetic core 12. The outer magnetic core 12 has a ring-shaped outer wall 121 and a receptacle 122. The receptacle 122 is used for accommodating the inner magnetic core 11. The inner magnetic core 11 is made of a high saturation flux density and low permeability material. The outer magnetic core 12 is made of a low saturation flux density and high permeability material. Namely, the inner magnetic core 11 is made of a material with a first saturation flux density and a first permeability, and the outer magnetic core 12 is made of a material with a second saturation flux density and a second permeability, wherein the first saturation flux density is higher than the second saturation flux density, and the first permeability is lower than the second permeability. In an embodiment, the inner magnetic core 11 is made of alloy powder core, and the outer magnetic core 12 is made of ferrite.

In this embodiment, the outer magnetic core 12 and the inner magnetic core 11 of the composite magnetic core assembly 1 are connected in series. The composite magnetic core assembly 1 can be applied to a magnetic element (e.g. an inductor) in order to enhance the performance of the magnetic element and reduce the fabricating time.

Figure 2A:
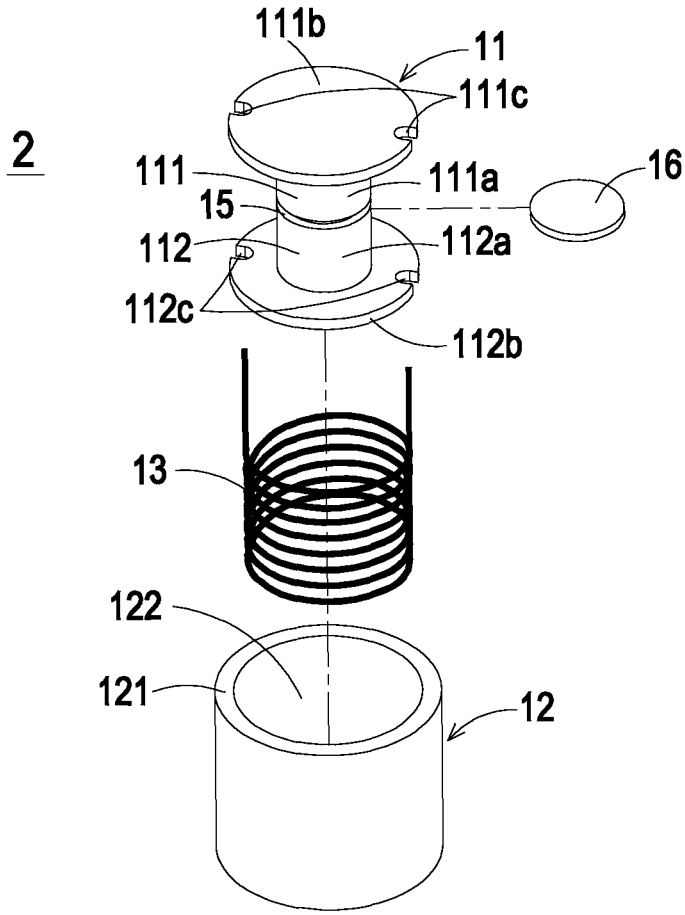
FIG. 2A is a schematic exploded view illustrating a magnetic element according to an embodiment of the present invention.
Figure 2B:
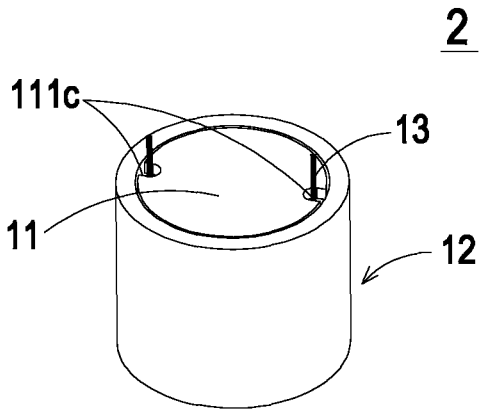
FIG. 2B is a schematic assembled view illustrating the magnetic element of FIG. 2A.

FIG. 2A is a schematic exploded view illustrating a magnetic element according to an embodiment of the present invention. FIG. 2B is a schematic assembled view illustrating the magnetic element of FIG. 2A. An example of the magnetic element 2 includes but is not limited to a power inductor or a filter inductor. As shown in FIGS. 2A and 2B, the magnetic element 2 comprises a composite magnetic core assembly 1 and a winding coil 13. The composite magnetic core assembly 1 comprises an inner magnetic core 11 and an outer magnetic core 12. The inner magnetic core 11 is made of a high saturation flux density and low permeability material (e.g. alloy powder core). The outer magnetic core 12 is made of a low saturation flux density and high permeability material (e.g. ferrite).

In this embodiment, the inner magnetic core 11 includes a first part 111 and a second part 112. The first part 111 of the inner magnetic core 11 comprises a first center leg 111*a* and a first slab 111*b*. The first center leg 111*a* is connected to the center of the first slab 111*b*. The second part 112 of the inner magnetic core 11 comprises a second center leg 112*a* and a second slab 112*b*. The second center leg 112*a* is connected to the center of the second slab 112*b*. The outer magnetic core 12 has a ring-shaped outer wall 121 and a receptacle 122. The receptacle 122 is used for accommodating the inner magnetic core 11. When the inner magnetic core 11 is accommodated within the receptacle 122, the inner magnetic core 11 is enclosed by the ring-shaped outer wall 121. It is preferred that the receptacle 122 of the outer magnetic core 12 is a channel. The winding coil 13 is a single-layered or multi-layered conductive wire or flat coil (e.g. copper wire or copper foil). The winding coil 13 is wound around the first center leg 111*a* and the second center leg 112*a* of the inner magnetic core 11, and arranged between the first slab 111*b* and the second slab 112*b*. After the inner magnetic core 11 and the winding coil 13 are accommodated within the receptacle 122, the magnetic element 2 is assembled.

An example of the alloy powder core includes but is not limited to Fe powder core, FeSi powder core, FeAlSi powder core, FeNi powder core, FeNiMo powder core, amorphous powder core, or a combination thereof. An example of the ferrite includes but is not limited to MnZn ferrite, NiZn ferrite, or a combination thereof. The saturation flux density of the high saturation flux density and low permeability material is at least 1.5 times of the low saturation flux density and high permeability material.

In some embodiments, several notches 111*c* are formed in the first slab 111*b* of the first part 111 of the inner magnetic core 11, and several notches 112*c* are formed in the second part 112 of the inner magnetic core 11. The terminals of the winding coil 13 are penetrated through the notches 111*c* and 112*c*.

Figure 3:
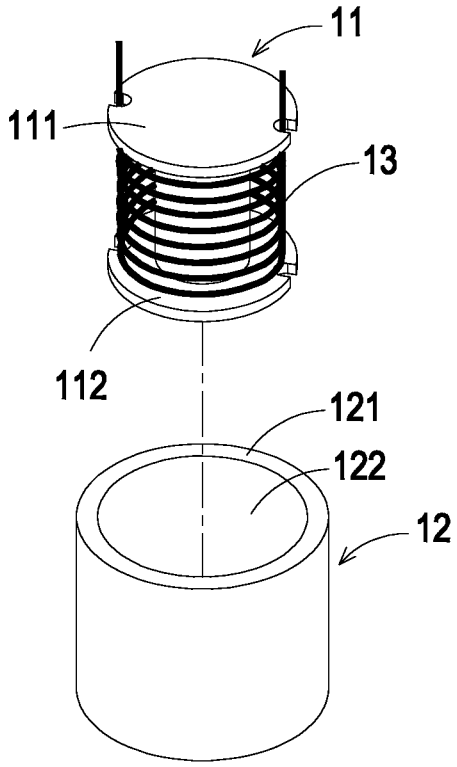
FIG. 3 is a schematic exploded view illustrating a variant of the magnetic element as shown in FIG. 2.

In some embodiments, as shown in FIG. 3, the first part 111 and the second part 112 of the inner magnetic core 11 are integrally formed such that the inner magnetic core 11 has an I-shaped cross section. In some embodiments, the tips of the first center leg 111*a* and the second center leg 112*a* are in contact with each other such that the inner magnetic core 11 has an I-shaped cross section. In some embodiments, an air gap 15 is formed between the first center leg 111*a* and the second center leg 112*a* of the inner magnetic core 11, as shown in FIG. 2A. An adhesive or an insulated piece 16 is inserted into the air gap 15 in order to maintain the length of the air gap 15. The insulated piece 16 is made of plastic, bakelite resin or glass steel. Since the inner magnetic core 11 made of alloy powder core has T-shaped first and second parts, the inner magnetic core 11 has an I-shaped cross section and the mean turn length of the winding coil 13 is reduced. In addition, the outer magnetic core 12 made of ferrite results in a closed magnetic path in order to reduce electromagnetic radiation.

The present invention also provides a method of fabricating the magnetic element in a simplified manner. Firstly, an inner magnetic core 11 made of a high saturation flux density and low permeability material, an outer magnetic core 12 made of a low saturation flux density and high permeability material and a winding coil 13 are provided, wherein the outer magnetic core 12 has a ring-shaped outer wall 121 and a receptacle 122. Then, the winding coil 13 is wound around the inner magnetic core 11, and the inner magnetic core 11 and the winding coil 13 are collectively accommodated within the receptacle 122 of the outer magnetic core 12. Meanwhile, the magnetic element 2 is assembled.

In some embodiments, the step of winding the winding coil 13 around the inner magnetic core 11 further includes sub-steps of forming an air gap 15 in the inner magnetic core 11, and inserting an adhesive or an insulated piece 16 into the air gap 15 in order to maintain the length of the air gap 15. The insulated piece 16 is made of plastic, bakelite resin or glass steel.

Figure 4A:
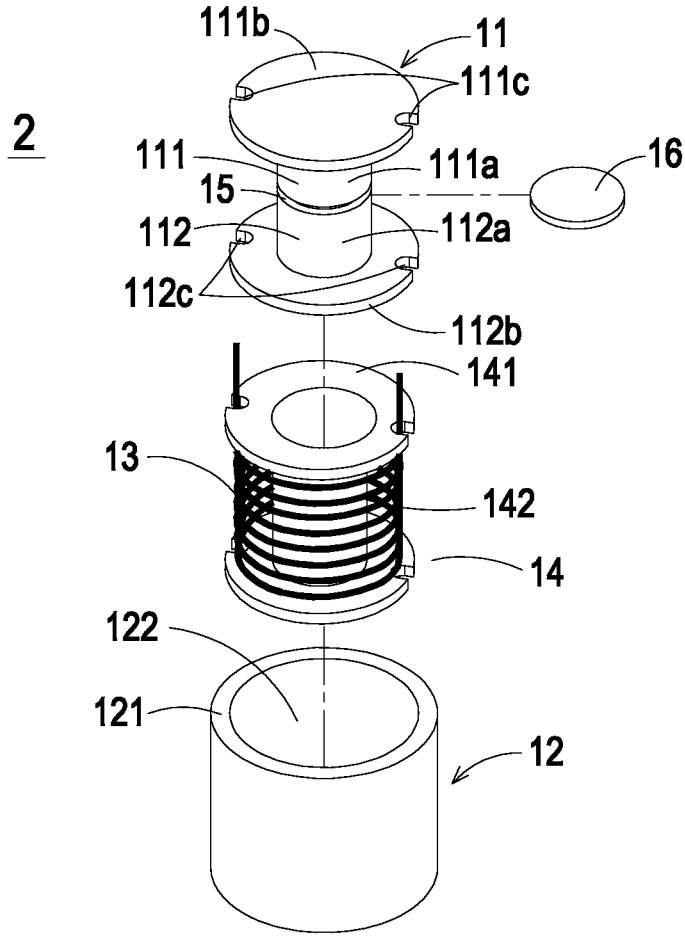
FIG. 4A is a schematic exploded view illustrating a magnetic element according to another embodiment of the present invention.
Figure 4B:
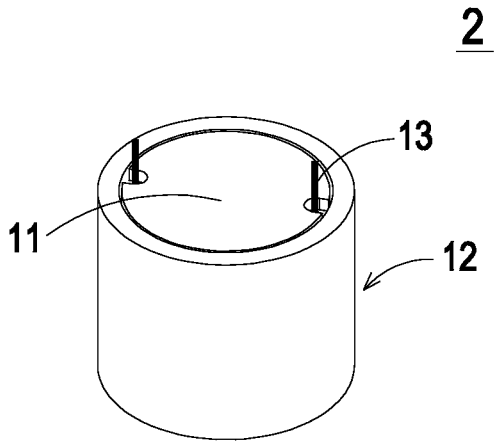
FIG. 4B is a schematic assembled view illustrating the magnetic element of FIG. 4A.

FIG. 4A is a schematic exploded view illustrating a magnetic element according to another embodiment of the present invention. FIG. 4B is a schematic assembled view illustrating the magnetic element of FIG. 4A. An example of the magnetic element 2 includes but is not limited to a power inductor or a filter inductor. As shown in FIGS. 4A and 4B, the magnetic element 2 comprises a composite magnetic core assembly 1, a winding coil 13 and a bobbin 14. The composite magnetic core assembly 1 and the winding coil 13 included in this embodiment are identical to those shown in FIGS. 2A and 2B, and are not redundantly described herein. In this embodiment, the bobbin 14 includes a channel 141 and a winding section 142. The inner magnetic core 11 is partially accommodated within the channel 141. The winding coil 13 is a single-layered or multi-layered conductive wire or flat coil. The winding coil 13 is wound around the winding section 142 of the bobbin 14. The inner magnetic core 11, the winding coil 13 and the bobbin 14 are collectively accommodated within the receptacle 122 of the outer magnetic core 12. Meanwhile, the magnetic element 2 is assembled.

An example of the alloy powder core includes but is not limited to Fe powder core, FeSi powder core, FeAlSi powder core, FeNi powder core, FeNiMo powder core, amorphous powder core, or a combination thereof. An example of the ferrite includes but is not limited to MnZn ferrite, NiZn ferrite, or a combination thereof. The saturation flux density of the high saturation flux density and low permeability material is at least 1.5 times of the low saturation flux density and high permeability material.

In some embodiments, several notches 111*c* are formed in the first slab 111*b* of the first part 111 of the inner magnetic core 11, and several notches 112*c* are formed in the second part 112 of the inner magnetic core 11. The terminals of the winding coil 13 are penetrated through the notches 111*c* and 112*c*. In some embodiments, the tips of the first center leg 111*a* and the second center leg 112*a* are in contact with each other such that the inner magnetic core 11 has an I-shaped cross section. In some embodiments, an air gap 15 is formed between the first center leg 111*a* and the second center leg 112*a* of the inner magnetic core 11. An adhesive or an insulated piece 16 is inserted into the air gap 15 in order to maintain the length of the air gap 15. The insulated piece 16 is made of plastic, bakelite resin or glass steel.

The present invention also provides a method of fabricating the magnetic element in a simplified manner. Firstly, an inner magnetic core 11 made of a high saturation flux density and low permeability material, an outer magnetic core 12 made of a low saturation flux density and high permeability material and a winding coil 13 are provided, wherein the outer magnetic core 12 has a ring-shaped outer wall 121 and a receptacle 122. Then, a bobbin 14 is provided, and the winding coil 13 is wound around the bobbin 14. Then, the bobbin 14 is sheathed around the inner magnetic core 11 such that the winding coil 13 is wound around the inner magnetic core 11. Afterwards, the inner magnetic core 11, the winding coil 13 and the bobbin 14 are collectively accommodated within the receptacle 122 of the outer magnetic core 12. Meanwhile, the magnetic element 2 is assembled.

In some embodiments, the step of sheathing the bobbin 14 around the inner magnetic core 11 further includes sub-steps of forming an air gap 15 in the inner magnetic core 11, and inserting an adhesive or an insulated piece 16 into the air gap 15 in order to maintain the length of the air gap 15. The insulated piece 16 is made of plastic, bakelite resin or glass steel.

Figure 5A:
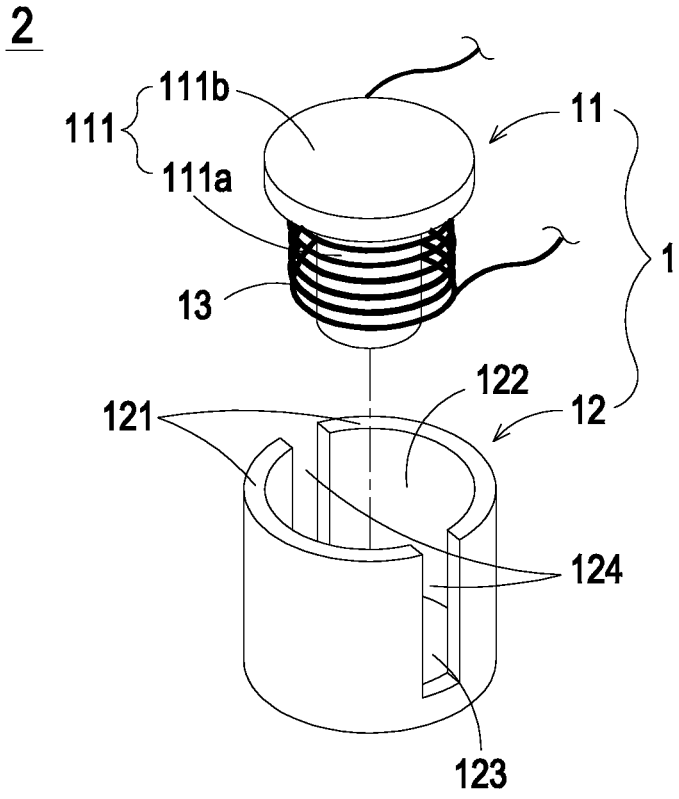
FIG. 5A is a schematic exploded view illustrating a magnetic element according to a further embodiment of the present invention.
Figure 5B:
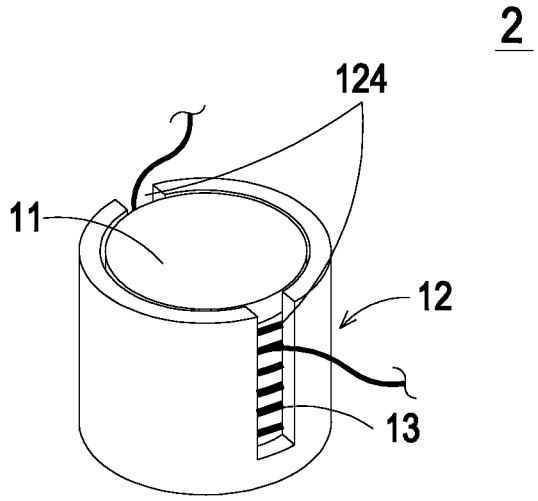
FIG. 5B is a schematic assembled view illustrating the magnetic element of FIG. 5A.

FIG. 5A is a schematic exploded view illustrating a magnetic element according to a further embodiment of the present invention. FIG. 5B is a schematic assembled view illustrating the magnetic element of FIG. 5A. An example of the magnetic element 2 includes but is not limited to a power inductor or a filter inductor. As shown in FIGS. 5A and 5B, the magnetic element 2 comprises a composite magnetic core assembly 1 and a winding coil 13. The composite magnetic core assembly 1 comprises an inner magnetic core 11 and an outer magnetic core 12. The inner magnetic core 11 is made of a high saturation flux density and low permeability material (e.g. alloy powder core). The outer magnetic core 12 is made of a low saturation flux density and high permeability material (e.g. ferrite).

In this embodiment, the inner magnetic core 11 only includes a first part 111. The first part 111 of the inner magnetic core 11 comprises a first center leg 111*a* and a first slab 111*b*. The first center leg 111*a* is connected to the center of the first slab 111*b* such that the first part 111 of the inner magnetic core 11 is T-shaped. The outer magnetic core 12 has a ring-shaped outer wall 121 and a receptacle 122. The receptacle 122 is used for accommodating the inner magnetic core 11. When the inner magnetic core 11 is accommodated within the receptacle 122, the inner magnetic core 11 is enclosed by the ring-shaped outer wall 121. Moreover, the receptacle 122 of the outer magnetic core 12 is defined by the ring-shaped outer wall 121 and a bottom 123, so that the outer magnetic core 12 is cup-shaped. The winding coil 13 is a single-layered or multi-layered conductive wire or flat coil (e.g. copper wire or copper foil). The winding coil 13 is wound around the first center leg 111*a* of the inner magnetic core 11. After the inner magnetic core 11 and the winding coil 13 are accommodated within the receptacle 122, the magnetic element 2 is assembled.

An example of the alloy powder core includes but is not limited to Fe powder core, FeSi powder core, FeAlSi powder core, FeNi powder core, FeNiMo powder core, amorphous powder core, or a combination thereof. An example of the ferrite includes but is not limited to MnZn ferrite, NiZn ferrite, or a combination thereof. The saturation flux density of the high saturation flux density and low permeability material is at least 1.5 times of the low saturation flux density and high permeability material.

In some embodiments, one or more grooves 124 are formed in the ring-shaped outer wall 121 of the ring-shaped outer wall 121. The terminals of the winding coil 13 are penetrated through the grooves 124.

The present invention also provides a method of fabricating the magnetic element in a simplified manner. Firstly, an inner magnetic core 11 made of a high saturation flux density and low permeability material, an outer magnetic core 12 made of a low saturation flux density and high permeability material and a winding coil 13 are provided, wherein the outer magnetic core 12 has a ring-shaped outer wall 121 and a receptacle 122. Then, the winding coil 13 is wound around the inner magnetic core 11, and the inner magnetic core 11 and the winding coil 13 are collectively accommodated within the receptacle 122 of the outer magnetic core 12. Meanwhile, the magnetic element 2 is assembled.

As known, the stored energy in an inductor may be calculated according to the following formula:

$$E = \frac{\mu_0 \cdot \mu_e \cdot H^2 \cdot A_e \cdot l_e}{2} = \frac{B^2 \cdot A_e \cdot l_e}{2 \cdot \mu_e \cdot \mu_0}$$

where, E is the inductor storage energy, $\mu_e$ is permeability, H is magnetic field, $A_e$ is cross-section area of magnetic flux, $l_e$ is length of magnetic path, and B is magnetic flux density.

In a case that the volume and the equivalent permeability are kept changed, alloy powder core has higher saturation flux density than ferrite. As such, the alloy powder core can store more energy than ferrite. Moreover, since ferrite has much higher permeability than alloy powder core, the magnetic pressure is predominately distributed on the alloy powder core and the energy storage is mainly dependent on the alloy powder core. Since the inner magnetic core 11 of the composite magnetic core assembly 1 is made of alloy powder core, the magnetic path is opened in order to facilitate winding the coil. The outer magnetic core 12 made of ferrite is used to close the magnetic path. Since the core loss of ferrite is very low, the loss increase is tiny by using of ferrite to close the magnetic path.

Moreover, the relation between the turn number, the cross-section area of magnetic flux and the length of magnetic path may be determined according to the following inductance formula:

$$L=\mu \cdot N^2 \cdot A_e / l_e$$

where, L is inductance, $\mu$ is permeability, N is turn number, $A_e$ is cross-section area of magnetic flux, and $l_e$ is length of magnetic path.

In a case that the turn number and the magnetic material are kept unchanged, the inductance may be adjusted by changing the cross-section area of magnetic flux and the length of magnetic path. As known, since the internal portion of the conventional ring-shaped magnetic core usually has a space for winding the coil, the filling ratio is insufficient and the magnetic path fails to be further shortened. In the composite magnetic core assembly 1 and the magnetic element 2 of the present invention, after the magnetic path is opened by the alloy powder core, the length of magnetic path may be adjusted as required. In other words, since the inductance is sufficient without providing an additional winding space, the length of magnetic path and the overall volume may be reduced. Since the permeability of magnetic core material results in inductance loss as the DC bias is increased or decreased, the reduction of the magnetic path may increase the inductance. Moreover, the winding coil may be previously made, and then integrated into the magnetic element (e.g. an inductor). In comparison with the manual winding process of the conventional ring-shaped powder core, the fabricating method of the present invention is simplified and time-saving. Moreover, since the conventional ring-shaped powder core has rectangular cross-section, the perimeter is not minimum and the mean turn length needs to be further improved (especially for the dual-ring winding mechanism). That is, if the wire of the inductor has a circular cross-section, the mean turn length is minimized and the resistor of the conductive wire is optimized.

During the process of assembling the magnetic element (e.g. an inductor), an assembling air gap occurs. Therefore, the influence of the air gap should be taken into consideration in designing the inductor. According to calculation, it is found that the air gap may enhance the anti-DC bias performance of the alloy powder core. For example, a high permeability alloy powder core (e.g. FeAlSi μ125 powder core) with an air gap has reduced permeability but the anti-DC bias performance thereof is superior to an alloy powder core having the equivalent permeability (e.g. FeAlSi μ26 powder core). By connecting alloy powder core and ferrite in series and providing a proper air gap, the size of the alloy powder core is reduced.

EXAMPLE 1

A conventional ring-shaped magnetic core of an inductor having a dimension of 35.8 mm×22.35 mm×10.46 mm and 70 turns of enamel-insulated wire (Φ1.5 mm) (by a dual-ring winding mechanism) is provided as a comparison sample. The ring-shaped magnetic core is made of FeAlSi powder core, and has an initial permeability value of 60 and a DC resistance of 45.9 nm. An exemplary magnetic element 2 of the present invention is an inductor. The magnetic element 2 has an air gap of about 0.5 mm. The inner magnetic core 11 is made of FeAlSi powder core, and has an initial permeability value of 26. The configurations of the magnetic element 2 are similar to those shown in FIGS. 2A and 2B. A three-layered enamel-insulated wire (Φ1.4 mm) with 48 turns is wound around the first part 111 and the second part 112 of the inner magnetic core 11. Then, the three-layered enamel-insulated wire and the inner magnetic core 11 are collectively accommodated within the receptacle 122 of the outer magnetic core 12 (made of ferrite). The resulting inductor has an assembling air gap of about 0.4 mm and a DC resistance of 38.1 nm. The measured inductance under maximum working current is increased by about 5%.

EXAMPLE 2

A conventional ring-shaped magnetic core of an inductor as described in Example 1 is provided as a comparison sample. An exemplary magnetic element 2 of the present invention is an inductor. The magnetic element 2 has an air gap of about 0.5 mm. The inner magnetic core 11 is made of FeAlSi powder core, and has an initial permeability value of 30. The configurations of the magnetic element 2 are similar to those shown in FIGS. 2A and 2B. A four-layered enamel-insulated wire (Φ1.29 mm) with 48 turns is wound around the first part 111 and the second part 112 of the inner magnetic core 11. Then, the four-layered enamel-insulated wire and the inner magnetic core 11 are collectively accommodated within the receptacle 122 of the outer magnetic core 12 (made of ferrite). The resulting inductor has an assembling air gap of about 0.4 mm and a DC resistance of 35.7 nm. The measured inductance under maximum working current is increased by about 7%.

EXAMPLE 3

Figure 6:
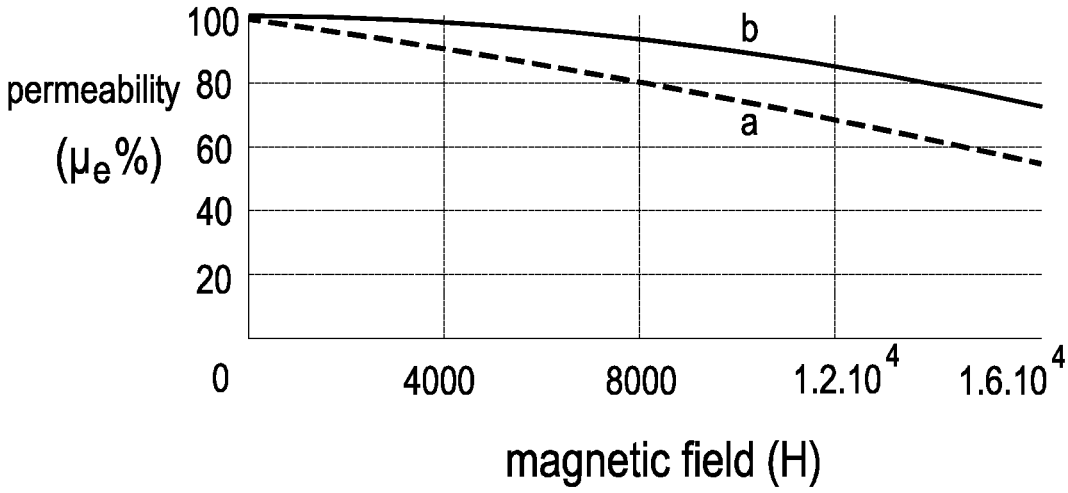
FIG. 6 is a plot illustrating the comparison of anti-DC bias performance between two exemplary inductors of the present invention.

A conventional ring-shaped magnetic core of an inductor having a dimension of 27.6 mm×14.1 mm×11.99 mm and 60 turns of enamel-insulated wire (Φ0.8 mm) is provided as a comparison sample. The ring-shaped magnetic core is made of FeAlSi powder core, and has an initial permeability value of 26. Two inductors of the present invention are used to compare the anti-DC bias performance. These two inductors have the same parameters except for the inner magnetic core 11. The inner magnetic core 11 of one inductor is made of FeAlSi μ26 powder core. The inner magnetic core 11 of the other inductor is made of FeAlSi μ125 powder core with an air gap such that the equivalent permeability is equal to 26. FIG. 6 is a plot illustrating the comparison of anti-DC bias performance between these two inductors. The curve "a" indicates the inductor having the FeAlSi μ26 powder core as the inner magnetic core. The curve "b" indicates the inductor having the FeAlSi μ125 powder core (with an air gap) as the inner magnetic core. As shown in FIG. 6, the anti-DC bias performance of the FeAlSi μ125 powder core (with an air gap) is superior to the FeAlSi μ26 powder core.

EXAMPLE 4

A conventional ring-shaped magnetic core of an inductor having the following parameters is provided: dimension of (18 mm×9 mm×10.2 mm)×2, initial permeability value of 125, FeNi powder core, six-strand enamel-insulated wire (Φ1.29 mm) with 3 turns. An exemplary magnetic element 2 of the present invention is an inductor. The magnetic element 2 has an air gap of about 0.5 mm. The inner magnetic core 11 is made of FeAlSi powder core, and has an initial permeability value of 90. The configurations of the magnetic element 2 are similar to those shown in FIGS. 5A and 5B. A wire (Φ2.2 mm) with 3 turns is wound around the inner magnetic core 11. Then, the wire and the inner magnetic core 11 are collectively accommodated within the receptacle 122 of the outer magnetic core 12 (made of ferrite). The resulting inductor has an assembling air gap of about 0.4 mm. In comparison with the conventional ring-shaped inductor, the core loss and the wire loss are reduced by more than 15%.

EXAMPLE 5

Figure 7:
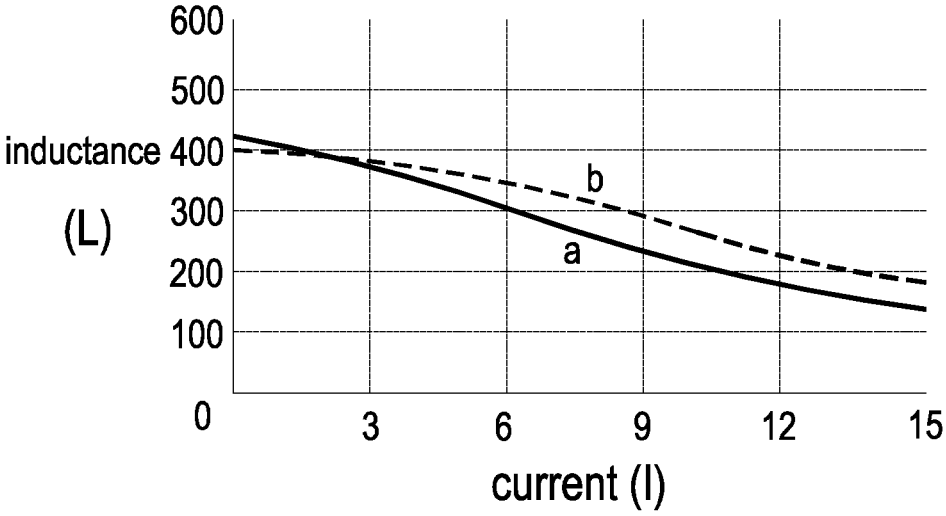
FIG. 7 is a plot illustrating the comparison of inductance under maximum working current between the inductor of the present invention and the conventional inductor.

A conventional power correction factor inductor having the following parameters is provided: dimension of 34.3 mm×23.37 mm×8.89 mm, initial permeability value of 60, FeNi powder core, dual-ring winding mechanism, enamel-insulated wire (Φ1.5 mm) with 59 turns, and DC resistance of 39.4 nm. An exemplary magnetic element 2 of the present invention is an inductor. The magnetic element 2 has an air gap of about 0.5 mm. The inner magnetic core 11 is made of FeAlSi powder core, and has an initial permeability value of 60. The configurations of the magnetic element 2 are similar to those shown in FIGS. 2A and 2B. A three-layered enamel-insulated wire (Φ1.4 mm) with 39 turns is wound around the first part 111 and the second part 112 of the inner magnetic core 11. Then, the three-layered enamel-insulated wire and the inner magnetic core 11 are collectively accommodated within the receptacle 122 of the outer magnetic core 12 (made of ferrite). The resulting inductor has an assembling air gap of about 0.4 mm and a DC resistance of 28.2 nm. The measured inductance under maximum working current is increased by about 5%. FIG. 7 is a plot illustrating the comparison of inductance under maximum working current between the inductor of the present invention and the conventional inductor. The curve "a" indicates the conventional ring-shaped inductor. The curve "b" indicates the inductor of the present invention. By a testing machine, it is found that the inductor of the present invention has enhanced overall efficiency. The efficiency obtained under the heavy load is considerably superior to the efficiency obtained under light load or null load.

EXAMPLE 6

A conventional output choke having the following parameters is provided: dimension of 18 mm×9 mm×10.2 mm, initial permeability value of 125, FeNi powder core, dual-ring winding mechanism, enamel-insulated wire (Φ1.0 mm×6) with 3 turns, and DC resistance of 0.7 nm. An exemplary magnetic element 2 of the present invention is an inductor. The magnetic element 2 has an air gap of about 0.5 mm. The inner magnetic core 11 is made of FeAlSi powder core, and has an initial permeability value of 60. The configurations of the magnetic element 2 are similar to those shown in FIGS. 2A and 2B. A 16.5 mm×0.4 mm copper foil with 4 turns is wound around the first part 111 and the second part 112 of the inner magnetic core 11. Then, the copper foil and the inner magnetic core 11 are collectively accommodated within the receptacle 122 of the outer magnetic core 12 (made of ferrite). The resulting inductor has an assembling air gap of about 0.4 mm, and a DC resistance of 0.58 mΩ. The size of the inductor is similar to that of the conventional ring-shaped inductor. The measured inductance under maximum working current is substantially equal to the conventional ring-shaped inductor. By a testing machine, it is found that the inductor of the present invention has enhanced overall efficiency.

From the above description, the composite magnetic core assembly, the magnetic element and the fabricating method of the present invention are capable of increasing operating efficiency, shortening fabricating time and reducing cost and overall volume by connecting alloy powder core and ferrite in series. The alloy powder core of the magnetic element is effective for winding the coil. In addition, the use of a bobbin to winding the coil may shorten the fabricating time. Since the mean turn length is reduced and the high saturation flux density of the alloy powder core reduces the cross-section area, the resistance of the composite magnetic core assembly is decreased and the conductive wire is saved. Under a large amount of current, the reduction of copper loss becomes more obvious. Since the outer magnetic core made of high permeability material (e.g. ferrite) has a function of shielding fringing flux, the possibility of causing the near-field radiation problem will be minimized. Moreover, the combination of the alloy powder core, the ferrite and the air gap improves the DC bias performance of the alloy powder core, enhances the function of the high saturation property, and reduces overall volume and cost of the inductor.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A composite magnetic core assembly comprising:

an inner magnetic core made of a high saturation flux density and low permeability material, wherein said inner magnetic core comprises a T-shaped first part and a T-shaped second part; and an outer magnetic core made of a low saturation flux density and high permeability material, wherein said outer magnetic core comprises a ring-shaped wall and a receptacle, and said inner magnetic core is accommodated within said receptacle.

2. The composite magnetic core assembly according to claim 1 wherein said high saturation flux density and low permeability material is alloy powder core, and said low saturation flux density and high permeability material is ferrite.

3. The composite magnetic core assembly according to claim 2 wherein said alloy powder core is selected from a group consisting of Fe powder core, FeSi powder core, FeAlSi powder core, FeNi powder core, FeNiMo powder core, amorphous powder core, and a combination thereof, and said ferrite is selected from a group consisting of MnZn ferrite, NiZn ferrite and a combination thereof.

4. The composite magnetic core assembly according to claim 1 wherein the saturation flux density of said high saturation flux density and low permeability material is at least 1.5 times of said low saturation flux density and high permeability material.

5. A magnetic element comprising:

a composite magnetic core assembly comprising an inner magnetic core and an outer magnetic core, wherein said inner magnetic core is made of a high saturation flux density and low permeability material, said inner magnetic core comprises a T-shaped first part and a T-shaped second part, said outer magnetic core is made of a low saturation flux density and high permeability material, said outer magnetic core comprises a ring-shaped wall and a receptacle, and said inner magnetic core is accommodated within said receptacle; and a winding coil wound around said inner magnetic core, and accommodated within said receptacle of said outer magnetic core.

6. The magnetic element according to claim 5 wherein said magnetic element is an inductor.

7. The magnetic element according to claim 5 wherein said high saturation flux density and low permeability material is alloy powder core, and said low saturation flux density and high permeability material is ferrite.

8. The magnetic element according to claim 7 wherein said alloy powder core is selected from a group consisting of Fe powder core, FeSi powder core, FeAlSi powder core, FeNi powder core, FeNiMo powder core, amorphous powder core, and a combination thereof, and said ferrite is selected from a group consisting of MnZn ferrite, NiZn ferrite and a combination thereof.

9. The magnetic element according to claim 5 wherein the saturation flux density of said high saturation flux density and low permeability material is at least 1.5 times of said low saturation flux density and high permeability material.

10. The magnetic element according to claim 5 wherein said inner magnetic core comprises:

said first part comprising a first center leg and a first slab, wherein said first center leg is connected to a center of said first slab; and said second part comprising a second center leg and a second slab, wherein said second center leg is connected to a center of said second slab.

11. The magnetic element according to claim 10 wherein said winding coil is wound around said first center leg and said second center leg of said inner magnetic core.

12. The magnetic element according to claim 10 wherein said first part and said second part of said inner magnetic core are integrally formed.

13. The magnetic element according to claim 10 wherein an air gap is formed between said first center leg and said second center leg, and an insulated piece is inserted into said air gap.

14. The magnetic element according to claim 5 wherein said winding coil is a conductive wire or flat coil.

15. The magnetic element according to claim 5 further comprising a bobbin accommodated within said receptacle of said outer magnetic core, wherein said bobbin comprises a channel and a winding section, said inner magnetic core is accommodated within said channel, and said winding coil is wound around said winding section of said bobbin.

16. The magnetic element according to claim 5 wherein said inner magnetic core comprises a center leg and a slab, said center leg is connected to a center of said slab, and said receptacle of said outer magnetic core is defined by said ring-shaped outer wall and a bottom.

17. A fabricating method of a magnetic element, said fabricating method comprising steps:

(a) providing an inner magnetic core made of a high saturation flux density and low permeability material, wherein said inner magnetic core comprises a T-shaped first part and a T-shaped second part, providing an outer magnetic core made of a low saturation flux density and high permeability material, and providing a winding coil, wherein said outer magnetic core has a ring-shaped outer wall and a receptacle; and (b) winding said winding coil around said inner magnetic core, and accommodating said inner magnetic core and said winding coil within said receptacle of said outer magnetic core.

18. The fabricating method according to claim 17 wherein said step (b) further includes sub-steps of forming an air gap in said inner magnetic core, and inserting an adhesive or an insulated piece into said air gap.

19. The fabricating method according to claim 17 wherein after said step (a) and before said step (b), said fabricating method further comprises a step of providing a bobbin, and winding said winding coil around said bobbin.

20. The fabricating method according to claim 19 wherein said step (b) further includes sub-steps of:

(b1) sheathing said bobbin around said inner magnetic core such that said winding coil is wound around said inner magnetic core; and (b2) accommodating said inner magnetic core, said winding coil and said bobbin within said receptacle of said outer magnetic core.

* * * * *